United States Patent [19]

Robbins et al.

[11] Patent Number: 4,979,380

[45] Date of Patent: Dec. 25, 1990

[54] AUTOMATED DYE PATTERN APPLICATION SYSTEM

[75] Inventors: Ronald B. Robbins; John D. Sakowski, both of Duncanville; William R. Walden, Seagoville, all of Tex.

[73] Assignee: Sakowski and Robbins Corporation, Dallas, Tex.

[21] Appl. No.: 406,367

[22] Filed: Sep. 12, 1989

[51] Int. Cl.[5] ..... D06B 1/02; D06B 11/00

[52] U.S. Cl. ..... 68/205.00 R; 118/323; 118/697; 346/29

[58] Field of Search ..... 68/205 R; 346/29; 118/697, 704, 323

[56] References Cited

U.S. PATENT DOCUMENTS

| | | | |
|---|---|---|---|
| 3,473,009 | 10/1969 | Gerber et al. | 349/29 X |
| 3,731,648 | 5/1973 | Gerber et al. | 118/697 |
| 3,796,184 | 3/1974 | Hawkins | 118/323 |
| 3,919,967 | 11/1975 | Warning et al. | 118/323 X |
| 4,024,836 | 5/1977 | Frank | 118/323 |
| 4,364,056 | 12/1982 | Suzuki et al. | 346/29 |
| 4,578,965 | 4/1986 | Brossman | 68/205 R |
| 4,584,964 | 4/1986 | Engel | 118/697 |
| 4,640,222 | 2/1987 | Gerber | 118/697 |
| 4,676,078 | 6/1987 | Ramsey | 68/205 R |
| 4,692,351 | 9/1987 | Maeda et al. | 118/697 X |
| 4,791,434 | 12/1988 | Wills | 68/205 R X |
| 4,872,417 | 10/1989 | Kuwabara et al. | 118/697 X |

OTHER PUBLICATIONS

"Ink Jet Flat-Bed Plotter", Booth et al., IBM Technical Disclosure Bulletin, vol. 21, No. 4, Sep. 1978.

*Primary Examiner*—Philip R. Coe

*Attorney, Agent, or Firm*—Litman, McMahon & Brown

[57] ABSTRACT

An automated dye pattern application system includes a support bed to support a mat or other dye receiving medium; perpendicular guide tracks supporting a carrier on which a dye spray head is mounted; stepper motors engaged between the tracks, the support bed, and the spray head carrier and forming an x-y plotter apparatus to move the spray head in two dimensions over the mat; and a pneumatic dye supply mechanism to supply liquid dye to the spray head and including control valves to actuate the spray of dye from the spray head. A dye control computer is interfaced to the stepper motors and valves and controls their operation. Data representing a digitized image is converted to a file of plotter commands to control the motors to scan the spray head over the mat and spray dye from the spray head at selected picture element locations to reproduce the digitized image in a colored dye pattern on the mat.

27 Claims, 4 Drawing Sheets

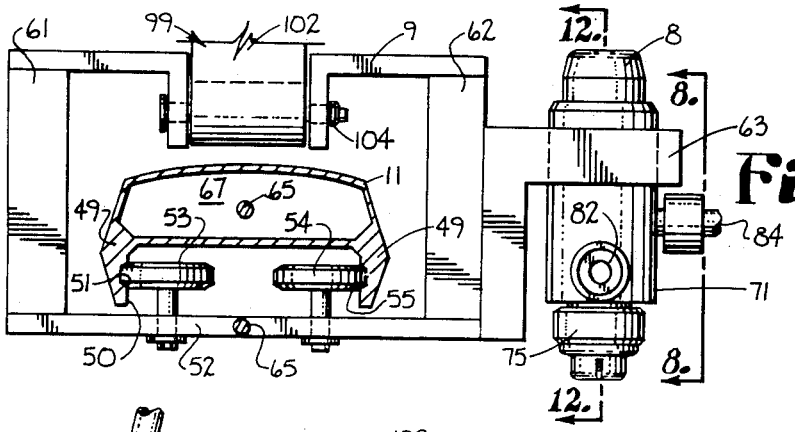
Fig. 7.
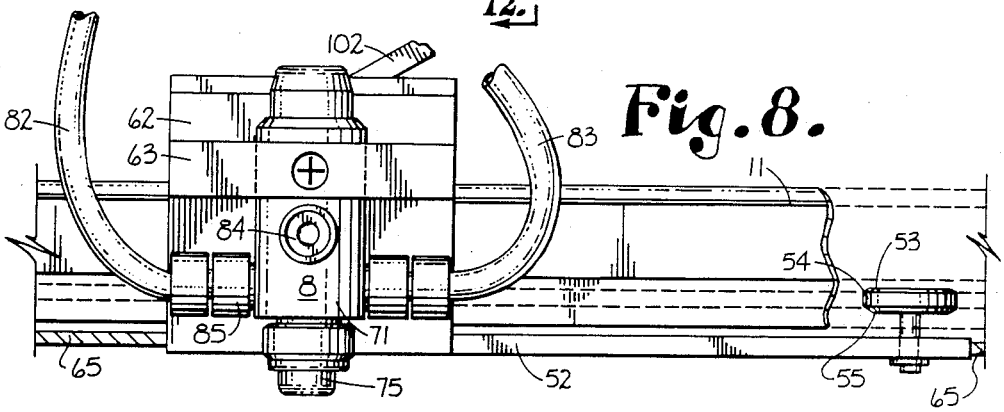
Fig. 8.
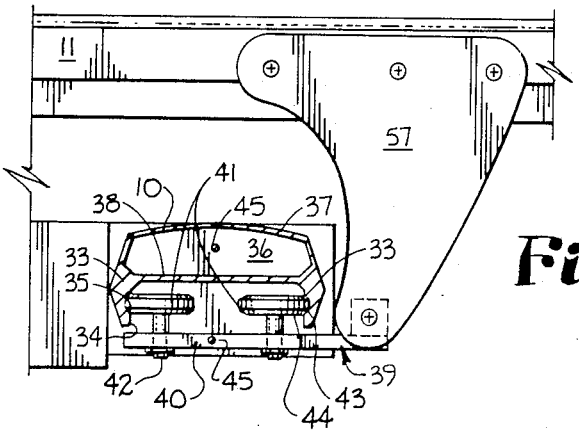
Fig. 9.
Fig. 10.
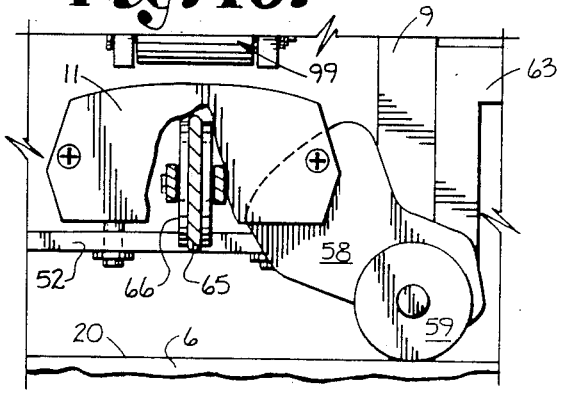
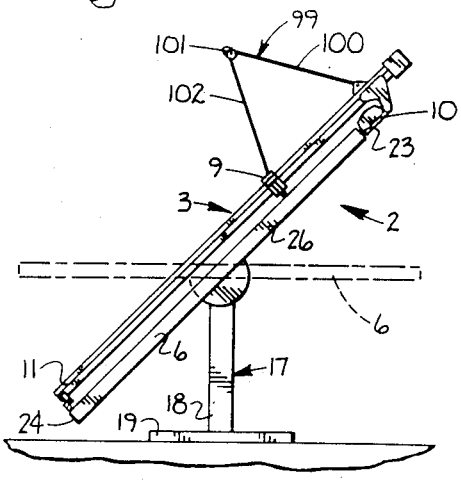
Fig. 11.

AUTOMATED DYE PATTERN APPLICATION SYSTEM

FIELD OF THE INVENTION

The present invention relates to graphic art systems and, more particularly, to a dye plotter system for spraying dye in selected patterns onto media, such as mats.

BACKGROUND OF THE INVENTION

Applying patterns or designs to carpets, mats, and other similar media is a popular and useful practice. Such a process may be used to welcome visitors, advertise a product or display a company's logo, or for decorating purposes, to name only a few uses. For many years, manual airbrushing, which uses compressed air to atomize and spray the dye, has been the only method for applying dye to these types of materials in patterns other than repeating or random types of patterns. Application by hand, however, is a time consuming and labor intensive project which often yields inconsistent results. Manually applying dyes to carpets, mats, and the like is subject to many problems. Each step in a manual process is subject to human error, and as the number of carpets to be finished with the same design increases, so does the possibility of inconsistent results. Variances in the patterns, such as dye thickness and pattern accuracy, is possible.

Historically, masks have been used to create patterns on carpets. In such a process, masks are placed on the rug and the entire rug is dyed minus the pattern of the masks. This method wastes dye because of the excessive spray coverage. Time is also wasted by the need to create, place, and remove the masks. Stencils also have been used to transfer a dye pattern to the dye receiving material. This process is similar to the use of masks except that only portions of the carpet not covered by the cut-out areas are dyed. Likewise, the use of stencils wastes dye materials, because of overspray. Also, the use of stencils and masks is not conducive to positioning dye in detailed patterns. The capability of applying the same dye pattern to a series of media is also desirable. Consequently, a need exists in the present industry for a faster, more accurate, and more consistent system for applying dye to dye receiving materials.

There have been some attempts at automating the application of dyes to media such as carpets, particularly in large manufacturing installations. In a typical arrangement of this type, a reciprocating dye spray head is positioned over a web conveyor moving an extended length of carpet thereunder. Such an arrangement is particularly useful for applying dye to the carpet in a repeating pattern or in a random pattern. However, the large scale of such an installation makes it unsuitable for smaller jobs, such as the application of custom patterns on small media, such as relatively small rugs, mats, and the like. Additionally, the arrangements heretofore employed are not flexible enough for quick change of the dye pattern to be applied or in the types of patterns which can be applied.

SUMMARY OF THE INVENTION

The present invention provides apparatus and methods which greatly enhance the application of dye patterns to relatively small media, such as rugs, mats, and the like. Essentially, the method of the present invention comprises digitizing a pattern or image to be applied to the media, storing the image in a computer, converting the image data into dye plotting commands, and communicating the plotting commands to intelligent controllers controlling stepper motors driving an enlarged x-y plotter type of device which scans a dye spray head over the dye receiving medium and sprays the dye according to the plotting commands.

The plotter apparatus includes a flat dye medium support bed mounted on a pedestal. A fixed guide track having one end of a mobile guide track riding thereon is mounted on the bed, the opposite end of the mobile track riding on the support bed. A mobile track carrier or bogie riding on the fixed track is configured to maintain a perpendicular relationship between the two tracks. A spray head carrier has a dye spray head mounted thereon and rides on the mobile track. A mobile track stepper motor is mounted on the fixed track and is connected by a cable and pulleys to the mobile track bogie. Similarly, a spray head stepper motor is mounted on the mobile track and is connected by a cable and pulleys to the spray head carrier. Preferably, the tracks have a cross sectional shape formed by a pair of downwardly projecting webs or flanges with inwardly turned ledges forming upwardly facing support shoulders. Each of the spray head carrier and mobile track bogie includes a carrier plate with sets of wheels positioned in a common plane. The wheels have tread surfaces which engage opposite faces of the webs and sidewall surfaces which engage the support shoulders of the ledges.

Liquid dye is supplied to the spray head and is driven therefrom by compressed air. The spray head is also controlled pneumatically. An air compressor supplies compressed air to an air tank which communicates with a solenoid operated pneumatic air control valve to a single input, multiple output pressure regulator manifold. A spray control valve line is routed from the regulator manifold to a cylinder within the spray head in which a spring return spray valve actuator piston is positioned. A needle valve is connected to the piston and is seated to normally block flow from an orifice of the spray head. When the spray head cylinder is pressurized, the piston is driven back and opens the needle valve. A spray drive conduit communicates compressed air from the regulator to a mixing chamber of the spray head. Finally, a dye volume conduit communicates air pressure to one or more dye supply containers, which may contain different color dyes. A dye conduit then communicates the liquid dye to the spray head mixing chamber and is connected thereto by a valving, quick disconnect connector.

When the air control valve is opened by a signal from the computer, compressed air is supplied to each of the compressed air lines at a pressure controlled by the regulator manifold. The liquid dye container is pressurized to positively supply the dye to the spray head. The spray control opens the needle valve, and the spray drive air forces the dye from the orifice in small droplets, the pattern of which is controlled by the pressure in the spray drive conduit. The quick disconnect dye conduit allows the color of the dye to be changed conveniently. Whenever the color is changed, the spray head may be purged by driving the new dye through the head for a short period. This may be controlled by a manually operated purge control. The support bed is provided with a purge funnel to receive the purge spray and route same to a suitable receptacle.

Each stepper motor is controlled by an analog controller interfaced by an intelligent indexer to the computer. One of the indexers is connected by a conventional serial interface to the computer, and has the other indexer "daisy chained" thereto. Each indexer is capable of controlling functions in addition to its motor. Specifically, the air control valve and a purge control switch are connected to a control port of one of the indexers. Each indexer has a limit switch connected thereto which is activated respectively by the mobile track bogie reaching a designated x-coordinate or the spray head carrier being driven to a designated y-coordinate. These designated coordinates define a hardware reference position to which all movement of the spray head is referenced.

The position of the spray head anywhere on the bed is determined in terms of stepper motor counts. Elongated mat position guides are mounted on the support bed and intersect at a starting position for the spray head. Both the purge funnel and the starting position are calibrated from the reference position in terms of two dimensional stepper motor counts. When the system is powered up, the computer causes the motors to move the head to the reference position and, thereafter, parks the spray head over the purge funnel. Similarly, after an image has been sprayed, the spray head is again parked over the purge funnel.

The dye control computer may be any of a number of types of personal computers having a central processing unit, input/output ports, a keyboard, floppy and hard disk drives, an adequate amount of read/write memory, and preferably a high resolution graphics capability. The images to be reproduced may be composed on the dye control computer itself using one of a number of conventional "paint" type programs capable of representing images in one of a number of standard image formats, or may be created on another computer. A mouse, or other type of pointing device, may be employed in such composition. The images may also be generated by the use of an optical scanner to scan a pictorial image. The image may be edited, enhanced, cropped, or otherwise manipulated by the paint program. Alternatively, the images may be created using object oriented types of graphics software, such as the type used for computer aided drafting and design (CADD).

The screen display of images created by paint programs is in the form of horizontal lines of picture elements or pixels scanned from left to right and top to bottom on the video display of the computer. In a monochrome paint image, an image data file representing the image is an array of On and Off bits which is repeatedly read by the display circuitry in synchronism with the sweep of the CRT (cathode ray tube) electron beam on the screen. In a digital color image, the image data file may include color attributes for each pixel to control the activation and intensity level of one or more of the color beams (red, green, and blue) to display a multiple color image.

The dye application machinery, including the stepper motors and dye supply valves and collectively referred to as the dye plotter, is controlled by the dye control computer which executes a plotting program. While it would be possible for the plotting program to be implemented in such a manner as to process the image pixel data directly, it is preferred that the image data be converted into a more convenient format, due to the configuration of the plotter apparatus.

On the plotter apparatus, the fixed track extends in the direction of a designated x-axis, and the mobile track extends parallel to a designated y-axis. Thus, the mobile track is moved parallel to the x-axis while the spray head is moved parallel to the y-axis. The normal sweep pattern of a CRT is to sweep a horizontal line from left to right, retrace downward, and repeat to complete the frame. On the plotter, the spray head and carrier weigh less than the combination of the mobile track, the head carrier, and the head. Thus, it is more efficient to sweep the head in the y-direction during spraying and then to increment the mobile track in the x-direction at the end of a line. Additionally, retracing on the plotter would be wasted motion, such that bidirectional sweeping of the spray head is desirable.

As the head is stepped to the end of a line, its position is maintained as the mobile track is incremented, then the head is stepped in the opposite direction. Finally, it would be possible for the spray head to be turned On and Off at each coordinate to be sprayed; however, this would slow the dye application process and would unnecessarily work the spray supply valves.

The present invention provides an image data format conversion program which processes the standard pixel data into a format which is used by the dye control computer to more efficiently control the plotter apparatus. The conversion converts the x-axis or horizontally oriented image data format used by the video display into a y-axis or vertically oriented format for use by the plotter apparatus. Every other y-axis line is inverted to allow bidirectional sweeping of the spray head. Bits in contiguous groups of similar bits are counted and saved with the bit state (On or Off) as plotter commands.

The plotter commands for an image are compiled into a plotter data file for that image. The plotter commands are processed by the plotting program to sweep the spray head over the dye receiving medium and to activate the spray head according to the location of the spray head. The conversion program may also perform a type of color separation function on a color image to allow spraying an image in multiple colors or colors to be assigned to certain regions of the image may be selected by the operator. In such a process, the color attributes of the image pixels are processed to form a plotter data file for each of a plurality of individual colors for a color image. During processing of such multiple color data file, each color is sprayed individually, and the spray head is parked at the purge funnel after each pass for a changeover of dye color.

OBJECTS OF THE INVENTION

The principal objects of the present invention are: to provide an improved system for applying dyes and similar types of materials in selected patterns and designs to media such as carpets, mats, and the like; to provide such a system which increases the flexibility of the types of designs and images which can be applied as dyes to media and the convenience with which changes of designs can be accomplished; to provide such a system which enhances the consistency of applying the same dye design repeatedly; to provide such a system which is quickly adaptable to applying designs to different sized media; to provide such a system which has the ability to apply multiple color designs to a single dye receiving medium; to provide such a system in which the dye plotting apparatus and control units therefor can be disassembled into relatively small parcels or sections for convenience in transportation thereof; to provide such a system in which the image or design to be applied as a dyed image can be optically scanned and digitized and the image data derived therefrom stored in a computer; to provide such a system in which the image can be composed and manipulated on a computer; to provide such a system in which the image data is used to cause a spray head moved by stepper motors in two dimensions to reproduce the scanned image on the media; to provide such a system in which the format of the image data is preferably converted from pixel on/off bits to plotter commands in which strings of nonchanging pixels are grouped in sequences of commands for the spray head to be moved according to the count of bits with the spray on or off according to the state of the pixel bits to expedite application of the image and to minimize wear of the dye application machinery; to provide such a system in which the spray head is mounted on a carrier riding along a mobile track which itself rides along a track perpendicular thereto and affixed to a bed supporting the dye receiving medium, one stepper motor being connected to move the mobile track and the other connected to move the spray head carrier whereby the spray head is movable in two dimensions to cover the medium; to provide such a system with guide tracks having a low profile configuration and low profile carriers having wheels arranged in a single plane to ride along the tracks; to provide such a system in which the control components and actuating components may be off-the-shelf components to economize construction of the apparatus of the system; to provide such a system in which the dye is sprayed onto the medium driven by compressed air and in which the spraying is controlled by the computer; to provide such a system with an umbilical handling arrangement including a hinged arm pivotally connected to the spray head carrier and to the mobile track, air and dye lines being routed through tubular sections of the arm; to provide such a system which is particularly adapted for a relatively small business to apply dye designs to media such as floor mats and small rugs; to provide such a system which is adaptable for spraying other materials such as inks and paints to other media, such as posters, signs, and the like to provide designs and images thereon; and to provide such a system for applying dyes to media which is economical to manufacture, convenient and precise in operation, and which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 7 is an enlarged fragmentary sectional view taken on line 7—7 of FIG. 4 and illustrates details of the dye spray head carrier of the dye plotter apparatus.

FIG. 8 is an enlarged fragmentary elevational view taken on line 8—8 of FIG. 7 and illustrates additional details of the spray head and carrier therefor.

FIG. 9 is an enlarged fragmentary sectional view taken on line 9—9 of FIG. 5 and illustrates details of a fixed guide track of the plotter apparatus.

FIG. 10 is an enlarged fragmentary end elevational view taken on line 10—10 of FIG. 5 and illustrates details of a movable guide track for the spray head carrier of the plotter apparatus.

FIG. 11 is a right side elevational view of the dye plotter apparatus at a reduced scale and illustrates the ability to tilt the dye medium support bed.

DETAILED DESCRIPTION OF THE INVENTION

Figure 1:
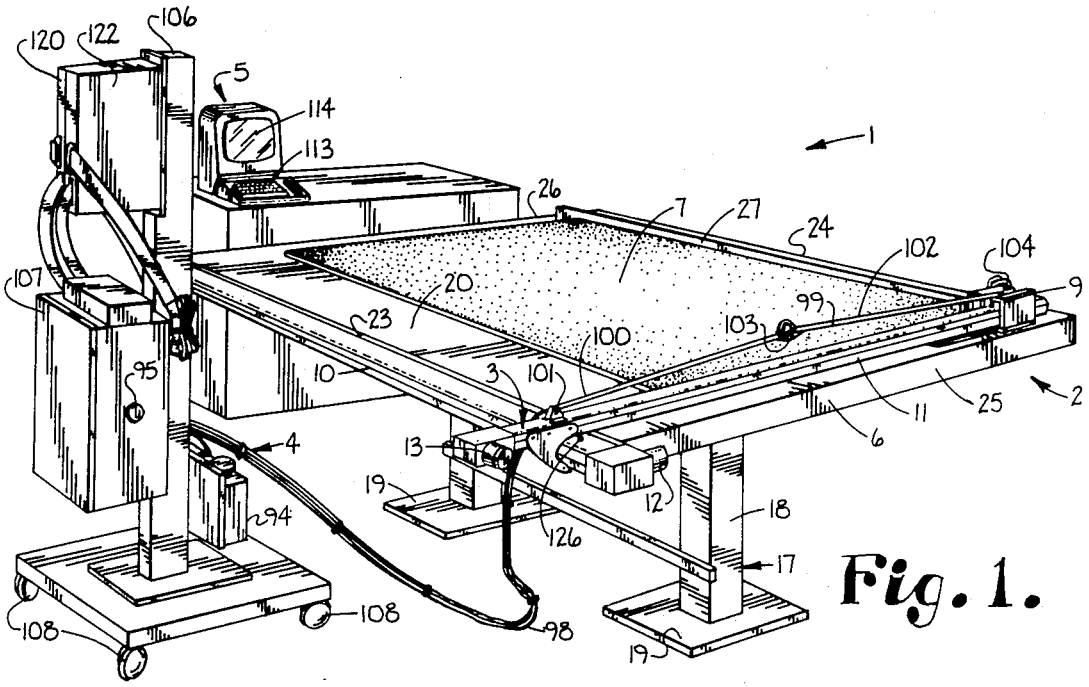
FIG. 1 is a perspective view of a dye plotter apparatus embodying the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are n<t to be interpreted as limiting, but merely as a basis for the claims and as a representative basis for teaching one skilled in the art to variously employ the present invention in virtually any appropriately detailed structure.

Figure 2:
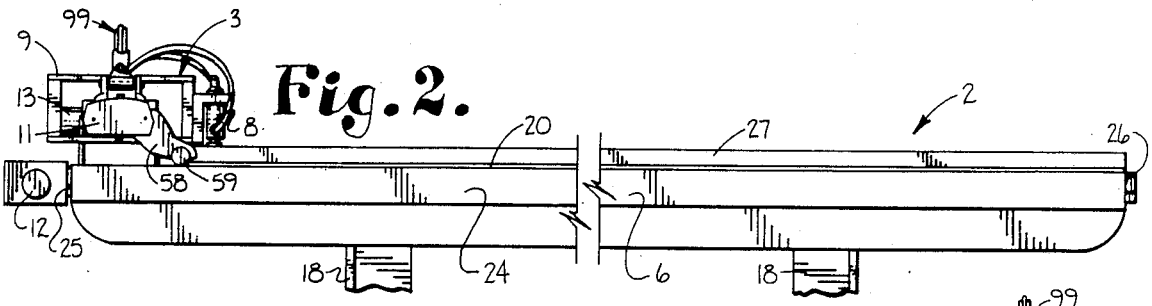
FIG. 2 is an enlarged fragmentary front side elevational view of the dye plotter apparatus.
Figure 3:
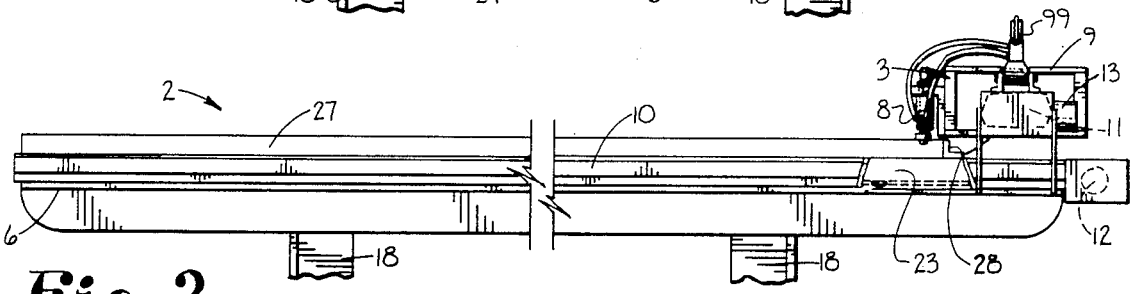
FIG. 3 is an enlarged fragmentary rear side elevational view of the dye plotter apparatus.
Figure 4:
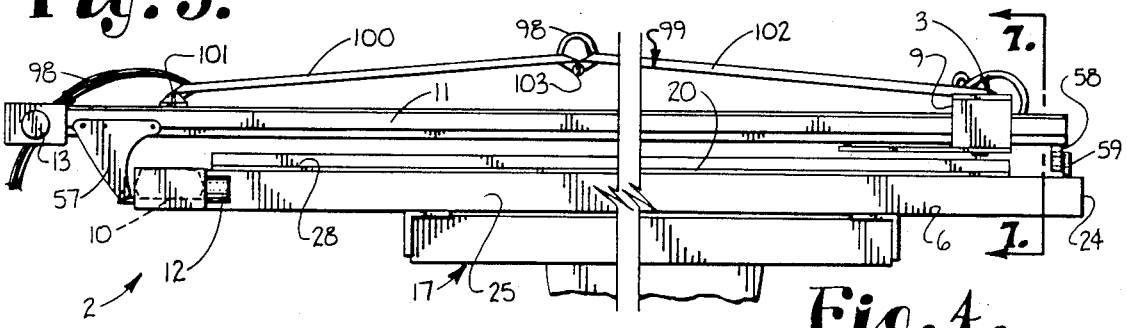
FIG. 4 is an enlarged fragmentary left side elevational view of the dye plotter apparatus.

Referring to the drawings in more detail:

The reference numeral 1 generally designates an automated dye pattern application system embodying the present invention. The system 1 includes a dye medium support structure 2, a dye plotter apparatus 3, a dye supply mechanism 4, and a dye plotting controller or computer 5. The support structure 2 includes a support bed 6 on which a dye receiving medium 7, such as a mat, is positioned. The dye plotter apparatus 3 generally includes a dye spray head 8 (FIGS. 2 and 3) mounted on a spray head carrier 9, guide members 10 and 11, and motors 12 and 13 operable to move the spray head 8 along a selected scan path over the mat 7. The dye supply mechanism 4 supplies a dye to the spray head 8 and causes it to be sprayed onto the mat 7. The computer 5 stores data representing an image or design to be reproduced on the mat 7 and executes a program which controls the motors 12 and 13 to scan the mat 7 along the scan path and controls the dye supply mechanism 4 to communicate dye to the spray head 8 at locations determined by the image data stored in the computer 5.

Figure 6:
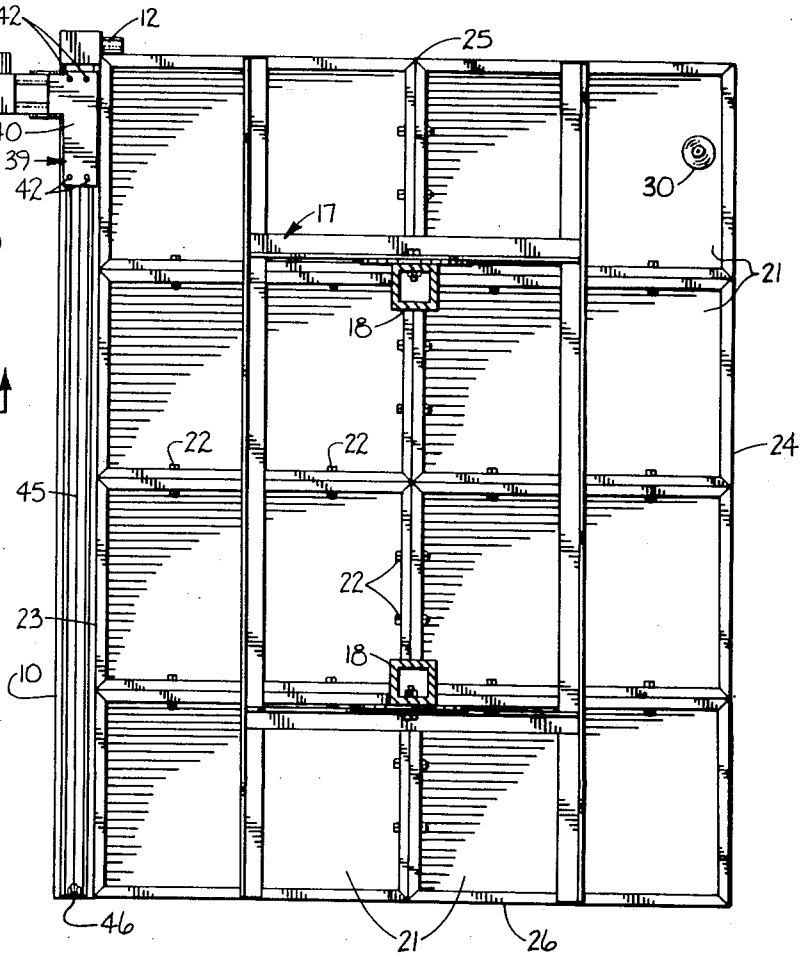
FIG. 6 is a bottom plan view of the dye plotter apparatus and illustrates sectional assembly details of a dye medium support bed of the apparatus.
Figure 5:
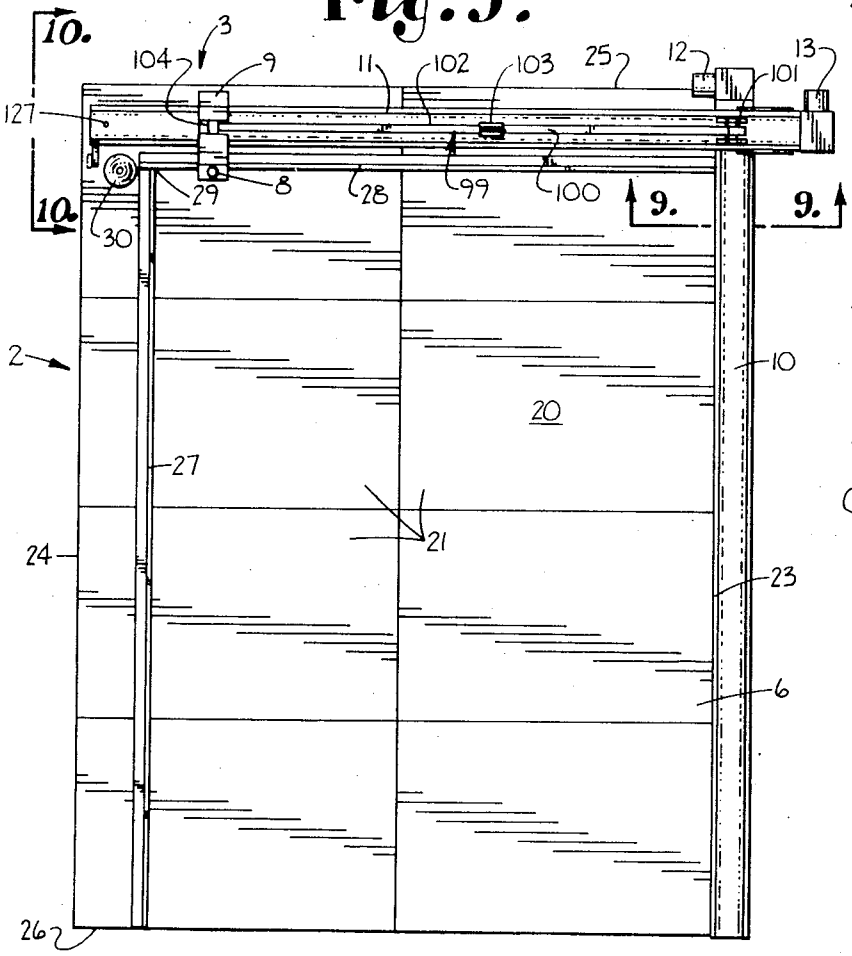
FIG. 5 is a top plan view of the dye plotter apparatus.

Referring to FIGS. 1, 5, and 6, the support structure 2 includes the support bed 6 which is mounted on a pedestal 17 including legs 18 and foot pads 19. The bed is pivotally connected to the pedestal 17 to allow the bed 6 to be tilted in a plurality of orientations and thereafter locked in position, as shown in FIG. 11, to facilitate some operations with the system 1. The support bed 6 is a rectangular structure with a flat upper support surface 20 which is sized to accommodate a variety of sizes of mats 7. The illustrated support bed 6 is formed of a plurality of rectangular subsections 21 which are joined by fasteners 22, such as bolts and nuts (FIG. 6).

The sectional configuration of the support bed 6 allows the support structure 2 to be disassembled for convenience in transportation. Although the bed 6 is often employed in a level orientation, orientation of the support bed 6 will be referred to herein by a designated top edge 23, bottom edge 24, a left edge 25, and a right edge 26 (see FIG. 5). A pair of perpendicularly oriented mat guides 27 and 28 are mounted on the upper surface 20 of the bed 6 and intersect at a dye spray starting position 29, which is just below the spray head 8 in FIG. 5. The mat guide 27 forms an x-axis or horizontal axis of the support bed 20, while the mat guide 28 forms a y-axis or vertical axis thereof. A purge funnel 30 is positioned on the bed 6 at a position in close proximity to the spray starting position 29 and at an integral number of steps of the motors 12 and 13 therefrom.

Referring to FIGS. 5, 6, and 9, the fixed x-axis track 10 is connected to the bed 6 along the front edge 23 thereof. The track 10 is an extrusion and includes a lower channel section formed of depending flanges or webs 33 with grooves formed along inside faces to define inwardly directed ledges 34 having upwardly facing support shoulders 35. An upper tubular chamber 36 is formed by an upper wall 37 and a center wall 38. The mobile y-axis track 11 is supported on the fixed track 1( by a mobile track carrier or bogie 39 formed of a support plate 40 having multiple sets of wheels 41 journaled on axles 42 and mounted thereon. The wheels 41 have tread surfaces 43 and sidewall surfaces 44. The axles 42 are oriented vertically and mutually parallel such that the wheels 41 are positioned in a common plane. The treads 43 ride in the grooves of the flanges 33, and the weight carried by the bogie 39 is supported by engagement of the sidewalls 44 with the support shoulders 35.

At least two longitudinally spaced sets of the wheels 41 are mounted on the plate 40, as indicated by the sets of axles 42 seen in FIG. 6, to maintain the perpendicular relationship of the mobile track 11 with the fixed track 10. The mobile track motor 12 is drivingly engaged with the bogie 39 by means of a mobile &rack cable 45 connected to opposite ends of the plate 40 and trained about a drive pulley (not shown) on a shaft of the motor 12 and an idler pulley 46 (FIG. 6) at an opposite end of the track 10 from the motor 12. An upper run of the cable 45 extends through the upper chamber 36.

Referring to FIG. 7, the mobile track 11 is a similar type of extrusion to that of the fixed track 10 and includes depending flanges or webs 49 with grooves forming inwardly directed ledges 50 which define<upwardly facing support shoulders 51. The spray head carrier 9 is formed by a hollow rectangular structure including a lower carrier plate 52 having sets of wheels 53 journaled thereon and positioned in a common plane. The wheels 53 include tread surface 54 and sidewall surfaces 55. The spray head carrier 9 is guided by the mobile track 11 by engagement of the treads 54 with the grooves of the flanges 49 and supported by engagement of the sidewalls 55 with the support surfaces 51 of the ledges 50.

The mobile track 11 is connected to the mobile track bogie 39 by a pivot bracket 57 which is attached to the track 11 at one end and which is pivotally connected to the bogie plate 40. At the opposite end from the bracket 57, a fixed orientation caster bracket 58 with a caster wheel 59 journaled thereon rides along the upper surface 20 of the support bed 6 to maintain the mobile track 11 parallel with the surface 20. The spray head carrier 9 includes at least two pairs of the wheels 53 positioned at longitudinally spaced locations to maintain the orientation of the carrier 9 with respect to the mobile track 11.

The carrier 9 includes upstanding side walls 61 and 62 connected to the plate 52. The side wall 62 has a spray head bracket 63 attached thereto which supports the spray head 8. The head carrier motor 13 is drivingly engaged with the carrier 9 by a head carrier cable 65 which is trained about a drive pulley (not shown) on the motor 13 and an idler pulley 66 (FIG. 10) positioned at an opposite end of the track 11 from the motor 13. The cable 65 is attached to opposite ends of the carrier plate 52 and extends through an upper chamber 67 of the mobile track 11.

Figures 12, 13:
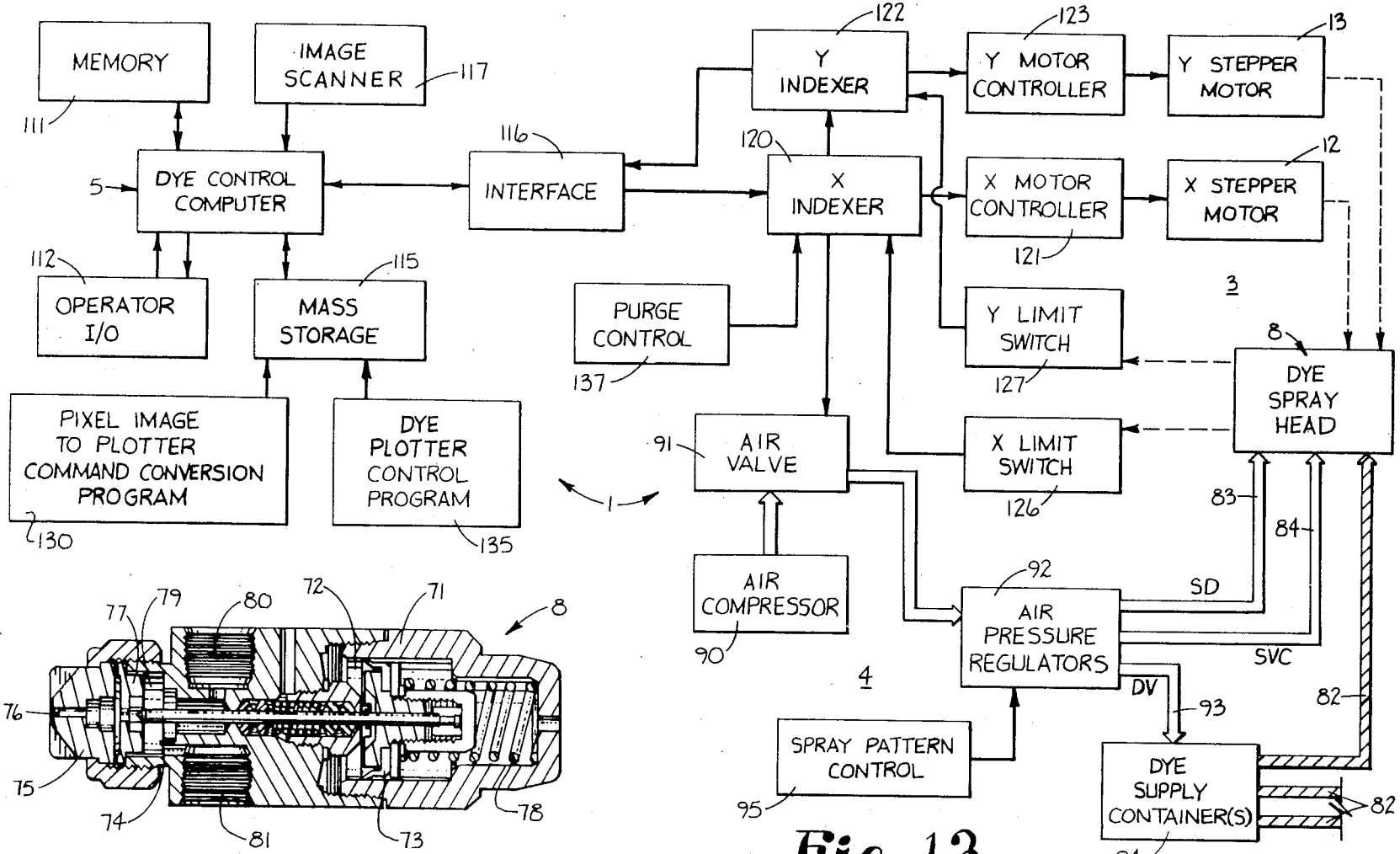
FIG. 12 is a greatly enlarged longitudinal sectional view of the dye spray head taken on line 12—12 of FIG. 7 and illustrates operational details thereof.

Referring to FIGS. 7, 8, and 12, the spray head 8 includes a spray head body 71 laving a spray valve cylinder 72 formed therein. A spray valve piston 73 is positioned within the cylinder 72 and has a needle valve member 74 connected thereto. A nozzle 75 with an orifice 76 formed therethrough is attached to an end of the body 71, and a valve seat member 77 is positioned between the nozzle 75 and has the needle valve 74 normally urged to close same by a piston return spring 78 engaged between the piston 73 and the body 71. A spray mixing chamber 79 is formed within the body 71 behind the valve seat member 77 and has a dye port 80 and a spray drive port 81 communicating therewith. A dye conduit 82 is connected to the dye port 80, and a spray drive compressed air line 83 is connected to the spray drive port 81. A spray valve control compressed air conduit 84 (FIGS. 7 and 8) is connected to a spray valve control port (not shown). Preferably, the dye conduit 82 is terminated by a valving quick disconnect connector 85 which closes upon disconnection from the dye port 80. This allows quick and convenient changeover of dye colors.

Referring to FIG. 13, the dye supply mechanism 4 includes an air compressor 90 <communicating through a master air valve 91 with a set of air pressure regulators 92. The compressor 90 may include a compressed air reservoir tank (not shown), according to the configuration of the compressor 90. The regulators 92 may be individual regulators or a single input/multiple output manifold type of arrangement. The spray drive conduit 83 and spray valve control conduit 84 are connected to outputs of the regulators 92. A dye volume compressed air conduit 93 is connected to one or more dye supply containers 94 which contain different color dyes. The dye volume conduit 93 pressurizes the containers 94 to positively urge dye in the dye conduits 82 into the mixing chamber 77 of the spray head 8. In the illustrated system 1, the regulators 92 provide compressed air at pressures of 4 to 6 pounds per square inch (psi) to the dye containers 94, 7 to 8 psi to the spray drive conduit 83, and 25 to 30 psi to the spray valve control conduit 84.

When it is desired to cause dye to spray from the spray head 8, the master air valve 91 is opened. This supplies compressed air to the spray drive conduit 83, the spray valve control conduit 84, and the dye volume conduit 93, substantially simultaneously and at the desired respective pressures. Air entering the spray valve cylinder 72 forces the piston 73 back against the force of the spring 78 thereby unseating the needle valve 74. This allows dye and spray drive compressed air to flow from the mixing chamber 79 through the orifice 76.

The pressure of the spray drive air combined with the geometry of the orifice 76 causes the liquid dye to be atomized and controls the pattern of spray therefrom. In general, the spray plume diverges in proportion to its distance from the orifice 76. Various types and colors of dyes have different viscosities. The viscosity of the dye also affects the pattern of spray. It is generally desirable to maintain a consistent spray pattern from dye to dye to achieve a consistent sprayed pixel size. The system 1 is provided with a spray pattern control 95 which, in the illustrated dye supply mechanism 4, consists of a throttle to control the regulator 92 associated with the spray drive conduit 83. It is foreseen that the spray head 8 could be mounted on the spray head carrier 9 by means of a motor (not shown) which could be controlled by the computer 5 to raise and lower the spray head 8 along a z-axis in relation to the sprayed medium 7 to compensate for varying dye viscosities. Such an arrangement could also be used to advantage in spraying dyes or like materials with a consistent spray pattern on a medium having a relief or depth pattern. It is also foreseen that it might be desirable to use the system 1 to reproduce images of different pixel resolutions or pixel size. The manual spray pattern control 95, particularly if well calibrated, or a spray head 8 movable along z-axis would be useful for such a capability.

The spray drive conduit 83, spray valve control conduit 84, and dye conduit or conduits 82, and possibly electrical cables, are bundled together at a flexible umbilical piping group or umbilical 98. It is desirable for the umbilical 98 to be routed to the spray head carrier 9 in such a manner as to avoid dragging it over the mat 7 during movement of the spray head 8, which may smear already sprayed areas, and to avoid possible damage to the lines of the umbilical 98. In the illustrated system 1, the umbilical 98 is routed through a hinged umbilical arm 99. The arm 99 includes a first arm section 100 which is pivotally connected to the mobile track 10 near the top edge 23 of the bed 6 at a shoulder joint 101. A second arm section 102 is pivotally connected to the first section 100 by an elbow joint 103 and to the spray head carrier 9 by a wrist joint 104. The sections 100 and 102 are tubular in construction, and the umbilical 98 is routed therethrough and supported thereby. At the elbow joint 103 and wrist joint 104, the umbilical 98 is provided with sufficient slack to avoid interference with pivoting of these joints.

Components of the dye supply mechanism 4 in the illustrated system 1 are mounted on a mobile service cart 106, although the cart 106 may also be stationary. Additionally, the dye containers 94 are mounted on the cart 106. A compressed air equipment housing 107 is mounted on the cart 106 and has the compressor 90, regulators 92, and master air valve 91 mounted therein. The umbilical 98 extends between the housing 10'' and the umbilical arm 99 with sufficient slack provided to prevent strain to the umbilical 98. If the cart 106 is mobile, it is preferred that means such as lockable casters 108 be provided thereon to allow the position of the cart 106 to be fixed once it has been properly positioned in relation to the dye medium support structure 2.

Referring to FIG. 13, the dye control computer 5 may be any one of a number of widely available personal computers, such as the IBM PC and AT computers (International Business Machines Corp.) and compatibles thereof, operating under the Microsoft Disk Operating System or MS-DOS (Microsoft Corporation), such as the IBM PS/2 Model 80. The programs for operating the computer 5 of the system 1 were written for use on such machines, but could be adapted for use on computers using different microprocessor families and operating under other operating systems. The computer 5 includes a central processing unit (not shown) to which is interfaced read/write memory 111 or RAM; operator input/output (I/0) devices 112, such as a keyboard 113 (FIG. 1), video display circuitry (not shown) to drive a video display screen 114, a mouse, and the like; and mass storage devices 115 such as floppy disk drives and a hard disk drive. The computer 5 also includes an interface 116 for controlling components of the dye plotter apparatus 3 and the dye supply mechanism 4, such as a conventional RS-232 serial interface. Alternatively, other types of standard or proprietary types of interfaces could be employed.

The illustrated computer 5 is provided with capabilities not only for controlling the dye plotter apparatus 3 and the dye supply mechanism 4, but also for generating and manipulating images to be reproduced and for converting the data format thereof. The dye control computer 5 may be provided with less power and capability if it is desired to use the computer 5 only as a dedicated controller for the system 1. In such a case, a separate computer, compatible with the computer 5, could be provided for developing the data files for operating the system 1. In order to allow images to be conveniently input into the preferred, general purpose, computer 5, an optical image scanner 117 is interfaced thereto. The scanner 117 may be a flatbed type of scanner or, preferably, a hand scanner, such as the Logitech ScanMan (Logitech, Inc.), the DFI Handy Scanner (Diamond Flower Electric Instrument Co.), or the like.

Such hand scanners operate in conjunction with software drivers to digitize a pictorial image across which the scanner is drawn and generate an image data file representing the image. The format of the image data file depends, to some extent, on the particular scanner 117 used, the software drivers, and whether or not the scanner has the capability of recognizing colors or gray levels in the scanned image. There are a number of standard formats for digitized images. Once the image data file has been generated, it may be stored in a mass storage device 115 for subsequent use. The image data file can be edited, added to, colored, or the like using a "paint" software, such as PaintShow+(Logitech, Inc.), PC Paintbrush (ZSoft Corp.), or the like.

The mobile track or x-axis stepper motor 12 is interfaced to the computer 5 through the interface 116 by an x-indexer 120 and an x-motor controller 121. Similarly, the spray head carrier or y-stepper motor 13 is interfaced by a y-indexer 122 and a y-motor controller 123. Each of the indexers 120 and 122 is an intelligent indexer having a microprocessor, nonvolatile RAM, ROM (read-only memory), and I/0 ports. The indexers 120 and 122 are interfaced to the computer interface 116 in such a manner that the computer 5 can communicate with each independently.

In general, the indexers .20 and 122 control the stepper motors 12 and 13 by outputting trains of pulses and maintaining stepper counts to track the positions of the motors. For reference purposes, the fixed track 10 is provided with an x-limit switch 126 (FIGS. 1 and 13), and the mobile track 11 is provide, with a y-limit switch 127 (FIGS. 5 and 13). The x-limit switch 126 is connected to an input port of the x-indexer 12 while the y-limit switch is connected to an input port of the y-indexer 122. The limit switch 126 for the x-axis is actuated whenever the mobile track 13 is stepped to a left most position or coordinate. Similarly, the y-limit switch 27 is actuated when the spray head carrier 9 is stepped to the lowermost position or coordinate. This combination ,f x and y coordinates defines a primary reference position on the support bed 6 to which all movement of the spray head 8 is referenced.

Similarly, the position of the purge funnel 30 and the spray starting position 29 are referenced to the primary reference position in terms of steps in the x and y directions. The x-motor controller 121 and the y-motor controller 123 are essentially analog circuits which provide the required power amplification to the pulses from the indexers 120 and 121 and isolate the indexers from the motors 12 and 13. The illustrated indexers 120 and 122 are combined respectively with the controllers 121 and 123 as Model 5240 indexer/drive packages, manufactured by the Pacific Scientific Company. The motors 12 and 13 are Model 2220 Non-Enhanced motors, also from Pacific Scientific. Other types of indexers, controllers, and motors are also contemplated.

An image data file for video display, in its simplest form, is normally a linear array of bytes, the bits of which are simply logic ones and zeros representing On and Off states of the CRT electron beam at each pixel of the displayed image. The video circuitry of the computer 5 scans through the array in synchronism with the sweep of the CRT beam and causes the beam t assume white and black levels, according to the scanned data, to reproduced the image on the screen 114. The data file may also include coding for each pixel for color or gray level information. This causes a monochrome CRT beam to reproduce a gray scale level or a one or more of three color CRT beams to be activated and assume a corresponding intensity level.

A beam of a conventional CRT is swept horizontally from left to right, retraced back t the left margin and down one line, and the process repeated for the number of lines of the display. The data content of the image data file is ordered in such a manner as to be, in effect, horizontally or x-axis oriented so that the video display circuitry can simply sequentially read the data representing the pixels to be displayed directly. While t would be possible for the spray head 9 of the dye plotter; apparatus 3 to be scanned in the same manner as a CRT beam is, this is not the most efficient use of the dye plotter apparatus 3, because of physical differences between it and a cathode ray tube.

Referring to FIG. 5, it is more energy efficient to scan the spray head carrier 9 and spray head 8 in the y-direction, or vertically, and periodically increment the bogie 39 and mobile track 11 in the x-direction, or horizontally, than vice versa. The carrier 9 and head 8 together weigh less than their combination with the weight of the bogie 39 and mobile track 11. Less motor torque, and thus less electrical power, is required to move the carrier 9 per motor step than the bogie 39. Thus, for a given image, less overall power is required to scan the carrier 9 along a column then increment the bogie 39 to the next column than to scan the bogie 39 across an entire row then increment the carrier 9 to the next row. Additionally, less vibration and reaction strain to the components of the support structure 2 and the plotter apparatus 3 results from column scanning the carrier 9. A retrace stroke of the spray head 8 from the end of one column to the opposite end of the next column is not required, as is row or line retracing in conventional vide displays. Such mechanical retracing of the spray head 8 ;would waste energy and time and unnecessarily wear the equipment.

Since the image data file for video display is ordered in an x-axis, row, or horizontal line format for efficient video display, it is desirable to reorder the image data into a y-axis, column, or vertically ordered format for efficient movement of the spray, head 8. The system 1 provides a conversion program 30 (FIG. 13) which processes an image data file representing an image in a standard video format and converts it into a sequence of plotter commands which facilitate operation of the dye plotter apparatus 3.

In particular, the conversion program 130 reorders the image data file to sequence the spray head 8 from the starting point 29 toward the designated top edge 23 to the top of a pixel column, increments the mobile track bogie 39 one column toward the right edge 26, then sequences the head 8 toward the designated bottom edge 24 in a repeating sequence of up column, column .right, down column, column right, and so on. The conversion program 130 scales the image displayed on the screen 14 to the size of the mat 7 to define a top margin relative to the x-mat guide 27 and a right margin relative to the y-mat guide 28.

It is unnecessary in the system 1 for the spray head 8 to stop at each pixel and sequence the air and spray valves 91 and 73 On then Off, if required for the image. The conversion program 130 strings together unchanging bit patterns by counting identical bit states and combining the required bit state with a motor step count, equal to the number of unchanging bits, to define a plotter command. This is similar, in some respects, to data compression techniques, as are sometimes used to economize the storage and facilitate the transmission of graphic data. A sequence of plotter commands will cause the spray head 8 to be moved a number of steps, activated t spray and moved a number of steps, deactivated and moved, and so on. The intelligent indexers 120 and 122 are capable of interactive programming and independent activation such that when the spray head 8 reaches the upper or lower margin of the mat 7, the x-indexer 120 is activated to increment the bogie 39 to the right one column, whether or not the spray head 8 is currently activated. This expedites the spraying process.

The plotter commands into which the image data file are converted are assembled into a plotter command file which is processed by a dye plotter control program 135. The plotter program 135 is executed by the dye control computer 5 to control operation of the plotter apparatus 3 and the dye supply mechanism 4 to reproduce the image in dye upon the mat 7. The conversion program 130 may perform a color or gray scale separation operation on the original image data file, if appropriate, and build a plotter command file for each individual color or gray level of the original image. Each image color or gray level component is sprayed separately.

Some images and designs might occupy only a small portion or subfield of the entire mat 7; therefore, the conversion program 130 may be provided with routines for use with such designs for setting up one or more secondary starting points, referenced to the primary starting point 29. The plotter command file is then processed into plotter command subfiles with sets of plotter commands referenced to respective secondary starting points. Such routines further streamline the plotting process by quickly moving the spray head 8 from the primary starting point 29 to a secondary starting point, causing an image component to be sprayed, and repeating for additional plotter command subfiles. Such a conversion technique could also be employed in reproducing images originating in an object oriented type of graphics format.

In operation, an image to be reproduced is input into the computer 5 by use of the 117, generated or drawn in the computer 5 using a paint program and a manual pointing device, or possibly generated mathematically by other software. An image data file containing data representing the image to be reproduced is processed by the pixel image to plotter command conversion program 130 to assemble one or more plotter command files, which may be stored in the mass storage device 115 of the computer 5 until needed.

When the image is to be reproduced, a mat 7 is positioned on the support bed 6 with a corner at the spray starting position 29. The computer 5 and components of the dye plotter apparatus 3 and the dye supply mechanism 4 are all activated. The dye plotter control program 135 is loaded into the memory 111 and executed. Communications are established with the indexers 120 and 122 through the interface 116, and a calibration routine is executed to reference the spray head to the purge funnel 30 and the spray starting position 29. In the calibration procedure, the x-motor 12 is activated to move the bogie 39 toward the x-limit switch 126, and the y-motor is activated to move the head carrier 9 toward the y-limit switch 127. When each limit switch is tripped, the corresponding motor is deactivated, and the step count for the corresponding indexer is set to zero. The motors 12 and 13 are activated to move selected numbers of steps to "home" the spray head 8 over the purge funnel 30.

At the purge funnel 30, a dye conduit 82 carrying the appropriate color dye, is connected to the spray head 8, and the head 8 may be purged of any residue of previously used dye by operation of a purge control 137 which is interfaced to the x-indexer 120. Operation of the purge control 137 causes the master air valve 91 to supply compressed air to the conduits 83, 84, and 93 to cause a purging spray of dye and compressed air from the spray head 8. When this has been completed, the system 1 is ready to reproduce a stored image onto the mat 7.

A plotter command file name is entered into the computer 5 to identify the image to be reproduced, causing the plotter program 135 to call the desired plotter command file. The plotter program 135 causes the spray head 8 to be indexed to the starting position 29, and the plotter commands are issued in sequence to the indexers 120 and 122 to cause the motors 12 and 13 to move the spray head in a selected path to cover the mat 7 and to cause the dye supply mechanism 4 to activate the spray head 8 at appropriate coordinates relative to the starting position 29. After the plotter command file has been exhausted, the plotter program 135 causes the spray head 8 to be homed back to the purge funnel 30. If a second color is to be sprayed, the original dye conduit 82 is replaced by a new dye conduit 82, and the spray head 8 is purged by operation of the purge control 137. The plotter program 135 calls up a plotter command file of a second color for the image, and the plotting process is repeated. When all the desired colors have been applied to the mat 7, the mat 7 may be removed and, if required, put through a dye setter process.

It is foreseen that the spray head carrier 9 could be provided with multiple dye spray heads 8 of various colors and connected by respective dye conduits 82 to dye containers 94. Valving (not shown) would be provided, as in the regulator manifold 92, for controlling which dye would be sprayed at a given time. Such valving could be controlled automatically by the computer 5 according to the color represented by a color component plotter command file. It would be necessary to space such multiple spray heads 8 an integral number of motor steps from one another and for indexing calibrations in relation to the starting position 29 to be made for each spray head 8 in use. Such multiple heads 8 would speed up the image reproduction process by eliminating much of the dye conduit interchanging and purging of the spray head 8 thereafter.

While the system 1 has been described specifically in terms of spraying dyes, the system 1 is also capable, with minor adaptations, of spraying other liquid colorant materials, such as inks, paints, and the like. And while the system 1 has been described principally in terms of a stationary support bed 6, usually positioned horizontally, it is foreseen that the system 1 could be advantageously made portable with the support bed 6 being an open frame for spraying images onto media 7 already in place, in both horizontal and vertical orientations.

It is to be understood that while certain forms of the present invention have been illustrated and described herein, it is not to be limited to the specific forms or arrangement of parts described and shown.

What is claimed and desired to be secured by Letters Patent is as follows:

1. An apparatus for applying dye to a dye receiving medium in a selected dye image pattern and comprising:

(a) dye spray head means including liquid spray means for spraying a liquid from said head and being adapted for at least indirect connection to dye medium support means for relative movement therebetween in at least two dimensions;

(b) spray head motor means adapted for at least indirect driving engagement between said head means and the support means and operable to cause relative movement therebetween in said at least two dimensions;

(c) remote dye supply means flow connected to said spray means and controllable to communicate a dye to said liquid spray means; and (d) control means having said motor means and said dye supply means connected thereto and controlling said motor means and said dye supply means to cause said relative movement between said head means and the support means and to cause communication of said dye to said liquid spray means in such a manner as to apply said dye to said dye receiving medium in said selected dye image pattern.

2. An apparatus as set forth in claim 1 wherein said control means includes:

(a) a dye control computer;

(b) interface means connecting said motor means and said dye supply means to said computer;

(c) memory means storing a dye application program and dye pattern data; and (d) said computer executing said program to process said dye pattern data to cause said motor means to cause relative movement of said spray head means and the support means in a selected path relative to a dye receiving medium on the support means and to cause communication of dye from said supply means to said head means at selected locations along said path according to said dye pattern data to thereby apply said dye to the medium in a selected dye image pattern.

3. An apparatus as set forth in claim 2 and including:

(a) scanner means interfaced with said computer and operable to optically scan an image, generate said dye pattern data representing said image, and input said data into said computer.

4. An apparatus for applying dye to a dye receiving medium in a selected dye image pattern and comprising:

(a) a dye spray head including spray means for spraying a liquid from said head;

(b) plotter means adapted to support the dye receiving medium, having said head mounted thereon, and including motor means controllable to cause relative movement between said head and the dye receiving medium to position said head at selected rectangular coordinates of said plotter means;

(c) remote dye supply means including dye conveying conduit means communicating with said head; and (d) control means having said motor means and said supply means connected thereto and controlling said motor means to cause said relative movement and to cause said supply means to selectively communicate said dye to said spraying means in such a manner as to apply said dye to the dye receiving medium in said selected dye image pattern.

5. An apparatus for applying dye to a dye receiving medium in a selected dye image pattern and comprising:

(a) dye medium support means having at least a two dimensional extent for supporting a dye receiving medium;

(b) a dye spray head including spray means for spraying a liquid from said head and including mounting means for mounting said head on said support means for movement in at least two dimensions;

(c) spray head motor means drivingly engaged between said support means and said head and operable to move said head in said at least two dimensions;

(d) remote dye supply means flow connected to said spray means; and (e) control means having said motor means and said dye supply means connected thereto and controlling said motor means and said dye supply means to move said dye spray head in relation to said dye receiving medium and to cause communication of said dye to said spray means in such a manner as to apply said dye to said medium in said selected dye image pattern.

6. An apparatus as set forth in claim 5 wherein:

(a) said support means includes a planar dye medium support bed;

(b) an elongated fixed track is connected to said bed and extends in a first direction;

(c) an elongated movable track is oriented in a second direction perpendicular to said fixed track, has one end engaging said fixed track and guided thereby to maintain a perpendicular relationship to said fixed track, and has an opposite end movably engaging said bed;

(d) a dye spray head carrier engages said movable track and has said spray head mounted thereon;

(e) said motor means includes a first motor and a second motor;

(f) said first motor is drivingly engaged between said fixed track and said movable track and is operable to cause reciprocation of said movable track relative to said fixed track; and (g) said second motor is drivingly engaged between said movable track and said carrier and is operable to cause reciprocation of said carrier along said movable track.

7. An apparatus as set forth in claim 6 wherein:

(a) each of said motors is a stepper motor.

8. An apparatus as set forth in claim 5 wherein said control means includes:

(a) a dye control computer;

(b) interface means connecting said motor means and said dye supply means to said computer;

(c) memory means storing a dye application program and dye pattern data; and (d) said computer executing said program to process said dye pattern data to cause said motor means to move said spray head in a selected path and to cause communication of dye from said supply means to said head at selected locations along said path according to said dye pattern data to thereby apply said dye to a dye medium in a selected dye image pattern.

9. An apparatus as set forth in claim 8 and including:

(a) scanner means interfaced with said computer and operable to optically scan an image, generate said dye pattern data representing said image, and input said data into said computer.

10. An apparatus as set forth in claim 5 and including:

(a) limit switch means associated with said spray head motor means, connected to said control means, and communicating a reference coordinate signal to said control means upon said motor means positioning said head at a two dimensional reference position of said support means.

11. An apparatus as set forth in claim 10 and including:

(a) a pair of perpendicular dye medium guides positioned on said support means and intersecting at a dye spray starting location positioned in spaced relation to said reference position.

12. An apparatus as set forth in claim 5 wherein said support means includes:

(a) a planar dye medium support bed structure;

(b) bed base means adapted for connection to said bed structure to support same above a floor; and (c) said bed structure being formed of a plurality of similar bed sections connected by removable fasteners to facilitate transportation of said bed structure.

13. An apparatus for applying dye to a dye receiving medium in a selected dye image pattern and comprising:

(a) planar, rectangular dye medium support means supporting a dye receiving medium;

(b) an elongated fixed track connected to said support means and extending in a first direction;

(c) an elongated movable track oriented in a second direction perpendicular to said fixed track, having one end engaging said fixed track and guided thereby to maintain a perpendicular relationship to said fixed track, and has an opposite end movably engaging said support means;

(d) a dye spray head carrier engaging said movable track;

(e) a first motor drivingly engaged between said fixed track and said movable track and operable to cause reciprocation of said movable track relative to said fixed track;

(f) a second motor drivingly engaged between said movable track and said carrier and operable to cause reciprocation of said carrier along said movable track;
(g) a dye spray head mounted on said carrier;
(h) dye container means containing a dye and communicating with said spray head;
(i) pneumatic dye supply means communicating with said container means and said head to pneumatically urge said dye from said container means and through said head; and
(j) control means having said motors and said dye supply means interfaced thereto and controlling said motor means and said dye supply means to move said dye spray head in relation to said dye receiving medium and to cause communication of said dye to said head in such a manner as to apply said dye to said medium in said selected dye image pattern.

14. A dye control system for a dye applying apparatus including dye receiving medium support means, a dye spray head, dye motor means connected between said support means and said head and operable to cause movement of said head relative to said support means, dye supply means, and dye valve means controlling communication between said dye supply means and said head, said system comprising:
(a) a dye control computer;
(b) interface means connecting said motor means and said valve means to said computer;
(c) memory means storing a dye application program and dye pattern data; and
(d) said computer executing said program to process said dye pattern data to cause said motor means to effect relative movement between said spray head and said support means in a selected relative path therebetween and to release said valve means at selected locations along said path to thereby apply said dye to said medium in a selected dye image pattern.

15. An apparatus as set forth in claim 14 and including:
(a) scanner means interfaced with said computer and operable to optically scan an image, generate said dye pattern data representing said image, and input said data into said computer.

16. An apparatus for applying dye to a dye receiving medium in a selected dye image pattern and comprising:
(a) dye spray head means adapted for at least indirect connection to dye medium support means for relative movement therebetween in at least two dimensions;
(b) elongated track means adapted for mounting on the support means;
(c) spray head motor means being drivingly engaged between said head means and said track means and operable to cause relative movement therebetween in said at least two dimensions;
(d) said spray head means being positioned on said track means and movable therealong;
(e) dye supply means controllable to communicate a dye to said head means;
(f) control means having said motor means and said dye supply means connected thereto and controlling said motor means and said dye supply means to cause said relative movement between said head means and the support means and to cause communication of said dye to said head means in such a manner as to apply said dye to said dye receiving medium in said selected dye image pattern;
(g) flexible umbilical piping means connected between said dye supply means and said spray head means;
(h) a first arm section pivotally connected to said track means by a shoulder joint;
(i) a second arm section pivotally connected to said first section by an elbow joint and pivotally connected to said head means by a wrist joint;
(j) first umbilical support means supporting said piping means along said first section between said shoulder and elbow joints;
(k) second umbilical support means supporting said piping means along said second section between said elbow and wrist joints; and
(l) said piping means being unsupported at said joints to prevent interference of pivoting of said joints by said piping means.

17. An apparatus for applying dye to a dye receiving medium in a selected dye image pattern and comprising:
(a) dye spray head means adapted for at least indirect connection to dye medium support means for relative movement therebetween in at least two dimensions;
(b) spray head motor means adapted for at least indirect driving engagement between said head means and the support means and operable to cause relative movement therebetween in said at least two dimensions;
(c) dye supply means controllable to communicate a dye to said head means;
(d) control means having said motor means and said dye supply means connected thereto and controlling said motor means and said dye supply means to cause said relative movement between said head means and the support means and to cause communication of said dye to said head means in such a manner as to apply said dye to said dye receiving medium in said selected dye image pattern;
(e) an elongated track member having a cross-section including generally downwardly projecting web means with opposite spaced apart faces having lower ledges extending in opposite directions therefrom, said ledges forming generally upwardly facing respective support shoulders;
(f) said spray head means including a spray head carrier with a dye spray head mounted thereon, said carrier including at least one pair of spaced apart wheels journaled thereon and positioned substantially in a common plane, each of said wheels having a circumferential surface and a sidewall surface;
(g) said carrier is positioned on said track member with said circumferential surface of each wheel engaging a respective face of said web means and with said sidewall surface engaging a support shoulder of a respective ledge; and
(h) means adapted for supporting said track member on the dye medium support means.

18. An apparatus for applying dye to a dye receiving medium in a selected dye image pattern and comprising:
(a) dye medium support means having at least a two dimensional extent for supporting a dye receiving medium;
(b) a dye spray head including means mounting said head on said support means for movement in at least two dimensions;

(c) spray head motor means drivingly engaged between said support means and said head and operable to move said head in said at least two dimensions;

(d) dye supply means controllable to supply dye to said head;

(e) control means having said motor means and said dye supply means connected thereto and controlling said motor means and said dye supply means to move said dye spray head in relation to said dye receiving medium and to cause communication of said dye to said head in such a manner as to apply said dye to said medium in said selected dye image pattern;

(f) said support means includes a planar dye medium support bed;

(g) an elongated fixed track connected to said bed and extending in a first direction;

(h) an elongated movable track oriented in a second direction perpendicular to said fixed track, and having one end engaging said fixed track and guided thereby to maintain a perpendicular relationship to said fixed track, and having an opposite end movably engaging said bed;

(i) a dye spray head carrier engaging said movable track and having said spray head mounted thereon;

(j) said motor means includes a first motor and a second motor;

(k) said first motor being drivingly engaged between said fixed track and said movable track and being operable to cause reciprocation of said movable track relative to said fixed track;

(l) said second motor being drivingly engaged between said movable track and said carrier and being operable to cause reciprocation of said carrier along said movable track;

(m) said movable track having a cross-section including generally downwardly projecting web means with opposite spaced apart faces having lower ledges extending in opposite directions therefrom, said ledges forming generally upwardly facing respective support shoulders;

(n) said carrier including at least one pair of spaced apart wheels journaled thereon and being positioned substantially in a common plane, each of said wheels having a circumferential surface and a sidewall surface; and (o) said carrier being positioned on said movable track with said circumferential surface of each wheel engaging a respective face of said web means and with said sidewall surface engaging a support shoulder of a respective ledge.

19. An apparatus for applying dye to a dye receiving medium in a selected dye image pattern and comprising:

(a) dye medium support means having at least a two dimensional extent for supporting a dye receiving medium;

(b) a dye spray head including means mounting said head on said support means for movement in at least two dimensions;

(c) spray head motor means drivingly engaged between said support means and said head and operable to move said head in said at least two dimensions;

(d) dye supply means controllable to supply dye to said head;

(e) control means having said motor means and said dye supply means connected thereto and controlling said motor means and said dye supply means to move said dye spray head in relation to said dye receiving medium and to cause communication of said dye to said head in such a manner as to apply said dye to said medium in said selected dye image pattern;

(f) said support means includes a planar dye medium support bed;

(g) an elongated fixed track connection to said bed and extending in a first direction;

(h) an elongated movable track oriented in a second direction perpendicular to said fixed track, having one end engaging said fixed track and guided thereby to maintain a perpendicular relationship to said fixed track, and having an opposite end movably engaging said bed;

(i) a dye spray head carrier engaging said movable track and having said spray head mounted thereon;

(j) said motor means including a first motor and a second motor;

(k) said first motor being drivingly engaged between said fixed track and said movable track and being operable to cause reciprocation of said movable track relative to said fixed track;

(l) said second motor being drivingly engaged between said movable track and said carrier and being operable to cause reciprocation of said carrier along said movable track;

(m) said fixed track having a cross-section including generally downwardly projecting web means with opposite spaced apart faces having lower ledges extending in opposite directions therefrom, said ledges forming generally upwardly facing respective support shoulders;

(n) said movable track being engaged with said fixed track by a track bogie connected to said movable track, said bogie including at least one pair of spaced apart wheels journaled thereon and being positioned substantially in a common plane, each of said wheels having a circumferential surface and a sidewall surface; and (o) said bogie being positioned on said fixed track with said circumferential surface of each wheel engaging a respective face of said web means and with said sidewall surface engaging a support shoulder of a respective ledge.

20. An apparatus for applying dye to a dye receiving medium in a selected dye image pattern and comprising:

(a) dye medium support means having at least a two dimensional extent for supporting a dye receiving medium;

(b) a dye spray head including means mounting said head on said support means for movement in at least two dimensions;

(c) spray head motor means drivingly engaged between said support means and said head and operable to move said head in said at least two dimensions;

(d) dye supply means controllable to supply dye to said head;

(e) control means having said motor means and said dye supply means connected thereto and controlling said motor means and said dye supply means to move said dye spray head in relation to said dye receiving medium and to cause communication of said dye to said head in such a manner as to apply said dye to said medium in said selected dye image pattern;

(f) said support means including a planar dye medium support bed;
(g) an elongated fixed track being connected to said bed and extending in a first direction;
(h) an elongated movable track being oriented in a second direction perpendicular to said fixed track, having one end engaging said fixed track and being guided thereby to maintain a perpendicular relationship to said fixed track, and having an opposite end movably engaging said bed;
(i) a dye spray head carrier engaging said movable track and has said spray head mounted thereon;
(j) said motor means including a first motor and a second motor;
(k) said first motor being drivingly engaged between said fixed track and said movable track and being operable to cause reciprocation of said movable track relative to said fixed track;
(l) said second motor being drivingly engaged between said movable track and said carrier and being operable to cause reciprocation of said carrier along said movable track;
(m) flexible umbilical piping means being connected between said dye supply means and said spray head;
(n) a first arm section pivotally being connected to said movable track means by a shoulder joint;
(o) a second arm section being pivotally connected to said first section by an elbow joint and being pivotally connected to said head means by a wrist joint;
(p) first umbilical support means supporting said piping means along said first section between said shoulder and elbow joints;
(q) second umbilical support means supporting said piping means along said second section between said elbow and wrist joints; and
(r) said piping means being unsupported at said joints to prevent interference to pivoting of said joints by said piping means.

21. An apparatus for applying dye to a dye receiving medium in a selected dye image pattern and comprising:
(a) dye medium support means having at least a two dimensional extent for supporting a dye receiving medium;
(b) a dye spray head including means mounting said head on said support means for movement in at least two dimensions;
(c) spray head motor means drivingly engaged between said support means and said head and operable to move said head in said at least two dimensions;
(d) dye supply means controllable to supply dye to said head;
(e) control means having said motor means and said dye supply means connected thereto and controlling said motor means and said dye supply means to move said dye spray head in relation to said dye receiving medium and to cause communication of said dye to said head in such a manner as to apply said dye to said medium in said selected dye image pattern;
(f) dye container means containing a dye and communicating with said spray head; and
(g) air compressor means communicating with said container means and said head to pneumatically urge said dye from said container means and through said head.

22. An apparatus as set forth in claim 21 and including:
(a) a spray drive conduit communicating between said compressor means and said head and communicating air under pressure to said head to drive said dye from said head in a spray pattern.

23. An apparatus as set forth in claim 22 and including:
(a) spray pattern control means positioned in said spray drive conduit and adjustable to vary pressure therein to thereby control said spray pattern from said head.

24. An apparatus as set forth in claim 21 and including:
(a) a pneumatic spray control valve positioned in said head to control spray of said dye from said head; and
(b) a pneumatic spray valve control conduit communicating between said compressor means and said spray control valve and controlling the operation of said spray control valve.

25. An apparatus as set forth in claim 21 and including:
(a) air valve means interposed between said compressor means and said container means and head, said air valve means being connected to said control means whereby said control means controls flow of compressed air to said container means and said head.

26. An apparatus for applying dye to a dye receiving medium in a selected dye image pattern and comprising:
(a) dye medium support means having at least a two dimensional extent for supporting a dye receiving medium;
(b) a dye spray head including means mounting said head on said support means for movement in at least two dimensions;
(c) spray head motor means drivingly engaged between said support means and said head and operable to move said head in said at least two dimensions;
(d) dye supply means controllable to supply dye to said head;
(e) control means having said motor means and said dye supply means connected thereto and controlling said motor means and said dye supply means to move said dye spray head in relation to said dye receiving medium and to cause communication of said dye to said head in such a manner as to apply said dye to said medium in said selected dye image pattern;
(f) a plurality of dye containers each containing a respective dye and a plurality of dye conduits connected respectively to said containers and communicating an associated dye therefrom;
(g) a quick disconnect connector terminating each dye conduit, said connector providing flow communication when connected and automatically preventing flow communication when disconnected, the connectors allowing disconnection of one dye conduit and connection of another dye conduit for selection of a dye;
(h) a selected one of said dye conduits being connected to said spray head to flow communicate an associated dye thereto; and
(i) air compressor means communicating with each dye container and said head to pneumatically urge said associated dye through said head.

27. An apparatus as set forth in claim 26 and including (a) a spray drive conduit communicating between said compressor means and said head and communicating air under pressure to said head to drive said dye from said head in a spray pattern;

(b) air valve means interposed between said compressor means and said container means and head, said air valve means being connected to said control means whereby said control means controls flow of compressed air to said container means and said head;

(c) purge sink means positioned at a purge position on said support means to receive a purge spray from said spray head, said control means normally causing said motor means to park said spray head at said purge position prior and subsequent to spraying a selected dye image pattern; and (d) a purge control interfaced to said control means and operable when said head is parked at said purge position to activate said spray head air valve means to thereby purge said spray head of a previous dye after disconnection of a previous dye conduit from said head and reconnection of a new dye conduit thereto.

* * * * *